US006991536B2

(12) United States Patent
Perrin

(10) Patent No.: US 6,991,536 B2
(45) Date of Patent: Jan. 31, 2006

(54) AIR FLOW CONTROLLER AND FIRE DAMPER IN AN AIR FLOW DUCT

(75) Inventor: Richard Perrin, Kent (GB)

(73) Assignee: Kent Tooling and Components Limited, Kent (GB)

( * ) Notice: Subject to any disclaimer, the term of this patent is extended or adjusted under 35 U.S.C. 154(b) by 0 days.

(21) Appl. No.: 10/433,309

(22) PCT Filed: Nov. 29, 2001

(86) PCT No.: PCT/GB01/05279

§ 371 (c)(1),
(2), (4) Date: Oct. 10, 2003

(87) PCT Pub. No.: WO02/43810

PCT Pub. Date: Jun. 6, 2002

(65) Prior Publication Data

US 2004/0058639 A1 Mar. 25, 2004

(30) Foreign Application Priority Data

Dec. 1, 2000 (GB) ..... 0029381
Apr. 24, 2001 (GB) ..... 0110056

(51) Int. Cl.
*A62C 2/12* (2006.01)

(52) U.S. Cl. ..... 454/369; 454/257

(58) Field of Classification Search ..... 454/369, 454/255, 257, 342; 169/42, 49
See application file for complete search history.

(56) References Cited

U.S. PATENT DOCUMENTS

| | | | | |
|---|---|---|---|---|
| 1,125,416 | A | | 1/1915 | Watson |
| 1,352,255 | A | | 9/1920 | Emerson |
| 2,242,738 | A | | 5/1941 | Alton |
| 2,270,073 | A | * | 1/1942 | Merry ..... 454/369 |
| 3,260,018 | A | * | 7/1966 | Schuh ..... 49/7 |
| 3,530,783 | A | * | 9/1970 | Alamprese ..... 454/335 |
| 3,543,439 | A | * | 12/1970 | Pantland ..... 49/7 |
| 3,669,405 | A | | 6/1972 | Baum |
| 4,060,096 | A | | 11/1977 | Schade |
| 4,114,646 | A | * | 9/1978 | McCabe ..... 137/601.09 |
| 4,177,716 | A | * | 12/1979 | Bowe et al. ..... 454/50 |
| 4,193,541 | A | | 3/1980 | Scheidweiler |
| 4,221,231 | A | | 9/1980 | Harvey et al. |
| 4,559,867 | A | | 12/1985 | Van Becelaere et al. |
| 4,581,987 | A | * | 4/1986 | Ulicny ..... 454/369 |
| 4,625,626 | A | | 12/1986 | Aalto |
| 4,646,847 | A | * | 3/1987 | Colvin ..... 169/49 |
| 4,958,687 | A | | 9/1990 | Nakagawa |

FOREIGN PATENT DOCUMENTS

| | | |
|---|---|---|
| DE | 2 261 153 | 7/1974 |
| DE | 26 09 449 | 9/1977 |
| DE | 39 33 997 A1 | 12/1982 |
| DE | 39 33 997 A | 5/1990 |

(Continued)

*Primary Examiner*—Derek S. Boles
(74) *Attorney, Agent, or Firm*—Dickstein Shapiro Morin & Oshinsky LLP

(57) ABSTRACT

A fire damper in an air duct (2) is formed by a flap (12) which in its closed position bears on a flange (6) which extends inward from the duct wall, to form a seal. The flap (12) is biased to the closed position and held open by a cable (24) which is gripped by a releasable mechanism, such as a ball clutch. The release is triggered by a fusible cartridge (34) which extends into the duct (2).

11 Claims, 7 Drawing Sheets

FOREIGN PATENT DOCUMENTS

| | | | |
|---|---|---|---|
| EP | 0 046 481 | A1 | 3/1982 |
| EP | 0 067 306 | A1 | 5/1982 |
| EP | 0 160 543 | A2 | 11/1985 |
| EP | 0 270 297 | A1 | 6/1988 |
| EP | 0 300 992 | A2 | 7/1988 |
| EP | 0 300 992 | A | 1/1989 |
| EP | 0 314 201 | A2 | 5/1989 |
| EP | 0 343 753 | A2 | 11/1989 |
| EP | 0 447 944 | A1 | 3/1991 |
| EP | 0 732 125 | A2 | 9/1996 |
| EP | 0 816 774 | A | 1/1998 |
| EP | 0 816 774 | A1 | 1/1998 |
| EP | 0 824 940 | A2 | 2/1998 |
| EP | 0 829 689 | A | 3/1998 |
| EP | 0 829 689 | A1 | 3/1998 |
| EP | 0 887 086 | A2 | 12/1998 |
| GB | 1 338 828 | | 11/1973 |
| GB | 2 103 483 | A | 2/1983 |
| GB | 2 103 775 | A | 2/1983 |
| GB | 2 107 982 | A | 5/1983 |
| GB | 2 136 106 | A | 9/1984 |
| GB | 2 176 279 | A | 12/1986 |
| GB | 2 230 951 | A | 11/1990 |
| GB | 2 255 014 | A | 10/1992 |
| GB | 2 255 278 | A | 11/1992 |
| GB | 2 260 793 | A | 4/1993 |
| GB | 2 271 166 | A | 4/1994 |
| GB | 2 329 196 | A | 3/1999 |
| GB | 2 330 772 | A | 5/1999 |
| GB | 2 333 598 | A | 7/1999 |
| WO | WO 84/01906 | | 5/1984 |
| WO | WO 84/01907 | | 5/1984 |
| WO | WO 86/05107 | | 9/1986 |
| WO | WO 87/04775 | | 8/1987 |

* cited by examiner

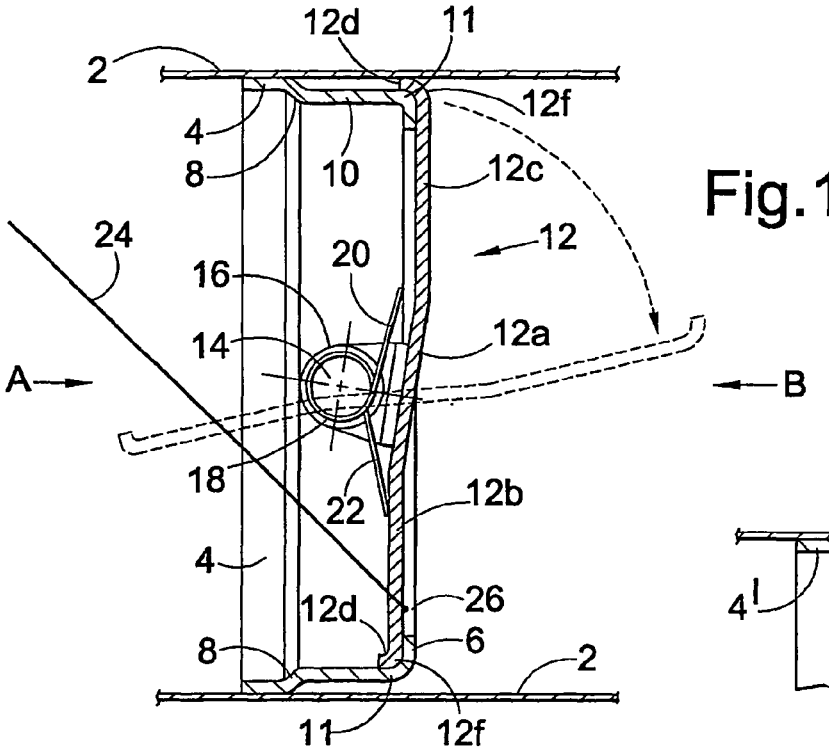
Fig.1
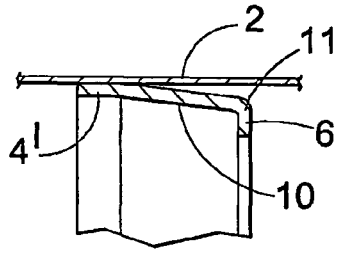
Fig.3
Fig.2
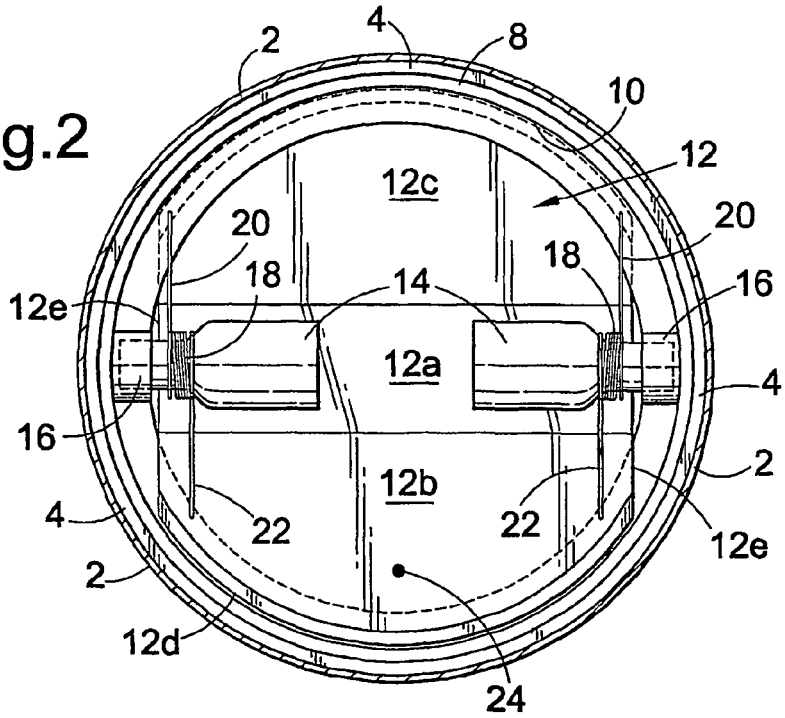

AIR FLOW CONTROLLER AND FIRE DAMPER IN AN AIR FLOW DUCT

The present invention relates to a fire damper for use in an air flow duct, and to a damper which can be used to regulate the flow of air in the duct.

Fire dampers in air flow ducts are well known. A commonly used form of damper consists of a flap inside the duct, which is held in an open position, extending along the duct axis. A heavy spring biases the flap to a closed position where it is transverse to the duct axis to block off the duct. A temperature sensitive trigger holds the flap in the open position and releases the flap in the event of a temperature rise caused by fire, such as a flame front moving through the duct.

The prior art system suffers from a number of drawbacks.

The seal between the duct wall and the flap relies only on the flap edge abutting the duct wall, and so smoke can move past the flap, although soot and other debris eventually help to form a seal. Distortion of the duct wall is a common occurrence and this impairs the seal.

Building regulations typically require installation of a fire damper in the wall of the room or compartment through which the duct passes. This makes access to the flap, to reset it, difficult. However, regulations also require that the flap be triggered many times on installation to ensure that it is functioning properly. Typically, the flap is mounted on an axle extending across the duct, and a handle on the axle extends outside the duct to enable an operator to return the flap to the open duct position.

Another draw back with the prior art system is that the flap is either fully opened or fully closed. It is often desirable to balance or control the flow through a duct, but the prior art design cannot use the flap for this additional purpose.

A first aspect of the present invention provides a fire damper in a ventilation duct, the damper comprising a flap which is pivotably mounted in the duct for movement from an open position, allowing air flow along the duct, to a closed position under the action of a biasing force to inhibit air flow or the passage of flame along the duct, wherein a rim is provided on the duct wall and the flap overlaps and bears on the rim when in the closed position.

Preferably the flap is pivoted about a centre axis. The rim may be stepped to accommodate opposite sides of the flap, but preferably the rim is in a single plane and the flap is stepped to mate with the flange.

As well as providing a better seal, the construction of the flap closing down onto a rim is more robust and better able to withstand continuous testing without distortion of the flap or surrounding duct. The rim, when mounted on the wall of the duct, serves to reinforce the duct shape. The rim may have a flange which extends laterally across the duct, the flap bearing on the flange when the flap is closed. Preferably the rim forms a corner and a co-operating corner is provided on the flap to form a seal at the corner.

Another aspect of the invention provides a damper in a ventilation duct, the damper comprising a flap which extends within the duct, wherein the flap is biased towards a first position, tending to open or close the duct, and a cable extends from the flap to the exterior of the duct, and means is provided for gripping the cable to hold the flap against the biasing force, whereby the orientation of the flap in the duct can be adjusted via the cable.

Preferably the flap is biased to a position closing the duct and a temperature actuated release is provided to trigger the release of the cable by the gripping means.

Very preferably the cable is gripped by a ball clutch. The cable may be pulled through the ball clutch, in the direction of flap opening, manually or by other means such as an electric motor or pneumatic device. It will be appreciated that the cable could also be turned around a pulley wheel which is rotated by a stepper motor or the like and released automatically to release the flap under control of a temperature sensor, override switch, etc.

Other aspects and preferred features of the invention will be apparent from the following description and the accompanying claims.

The invention will now be described by way of example with reference to the accompanying drawings, in which:

FIG. 1 shows schematically in cross-section a first embodiment of the invention, which is particularly suitable for small size ducts, typically up to 25 cm or 35 cm across but can also be used with larger size ducts;

FIG. 2 is a view on arrow A of FIG. 1;

FIG. 3 shows a modification of the embodiment of FIG. 1;

Figure 6:
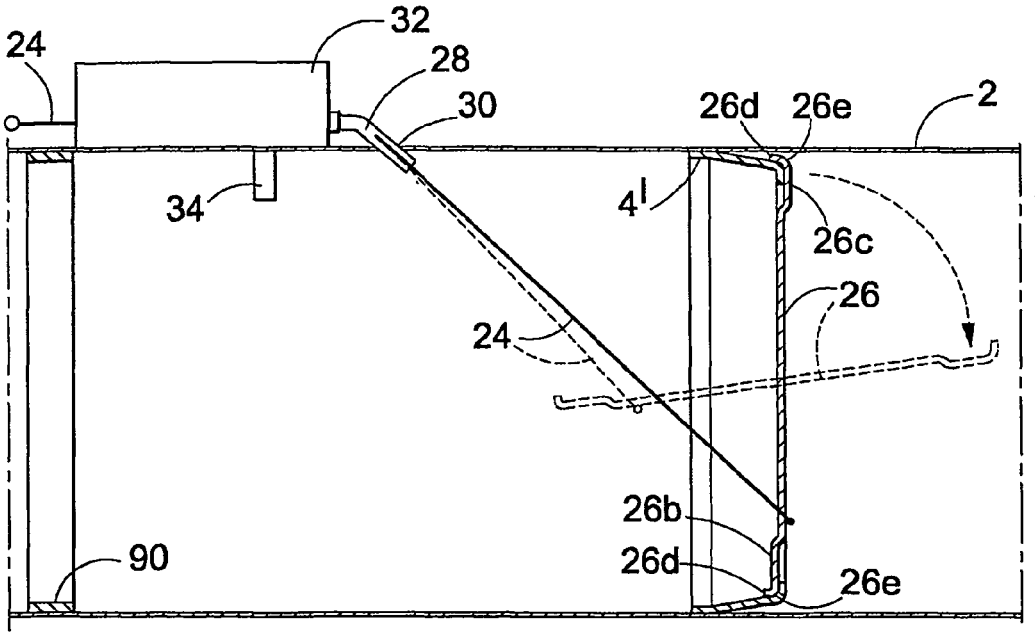
FIG. 6 is a cross-section view illustrating a control mechanism of the invention.
Figure 11B:
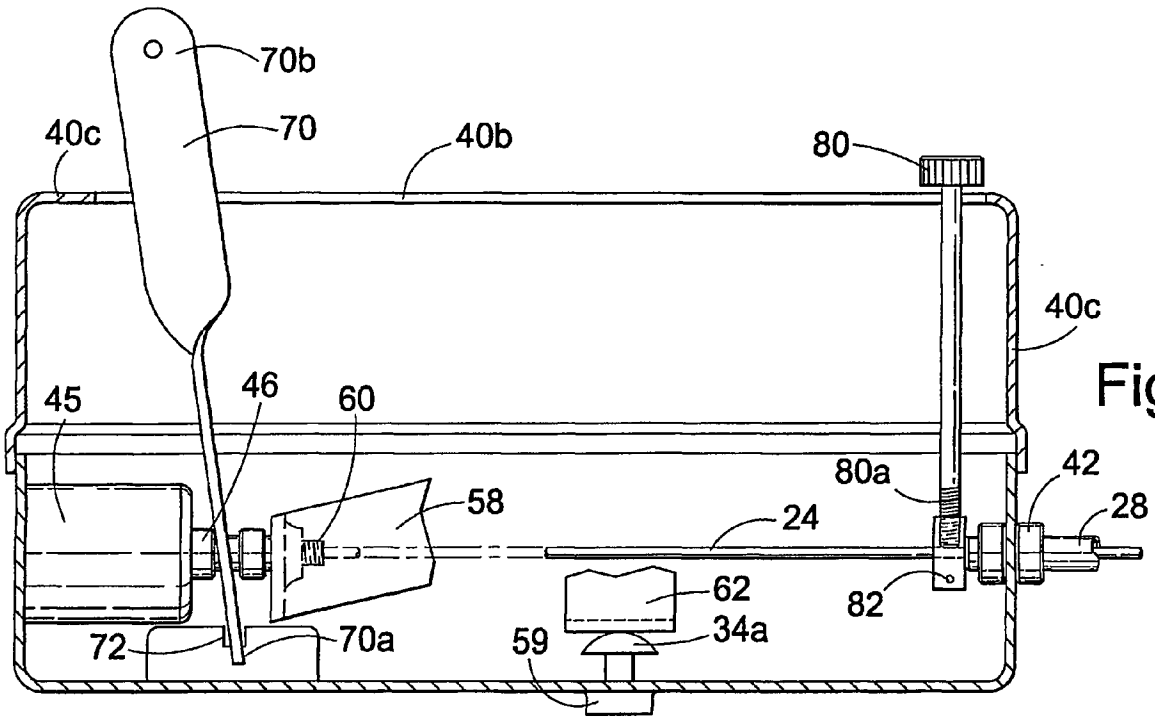
Figure 11A:
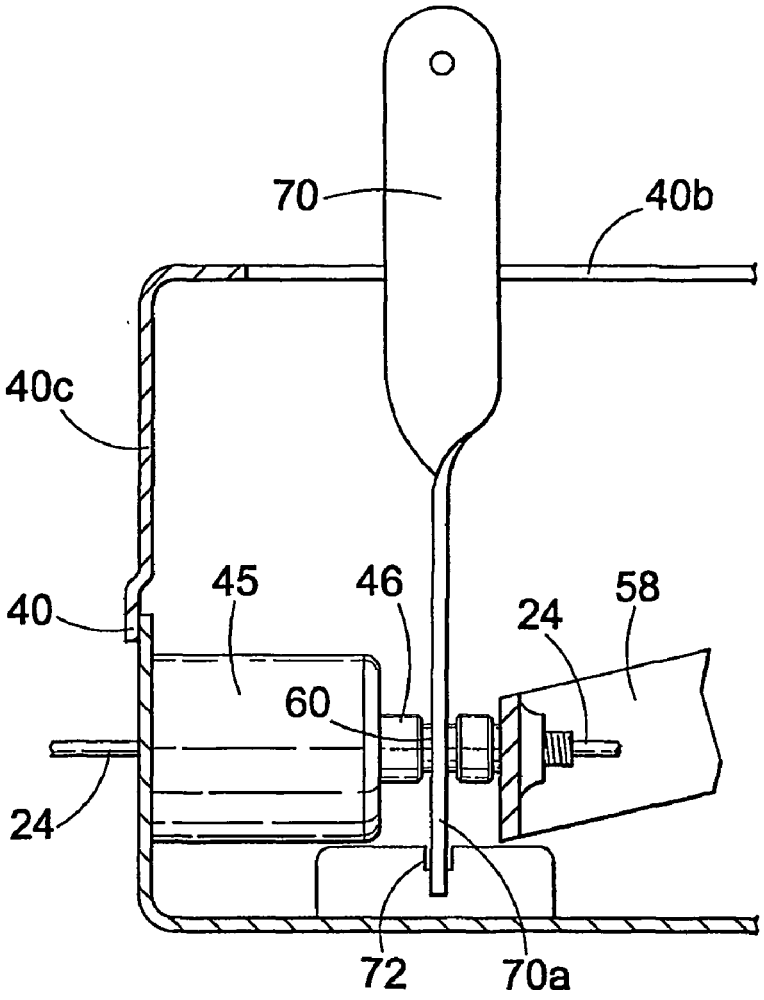
Figure 12:
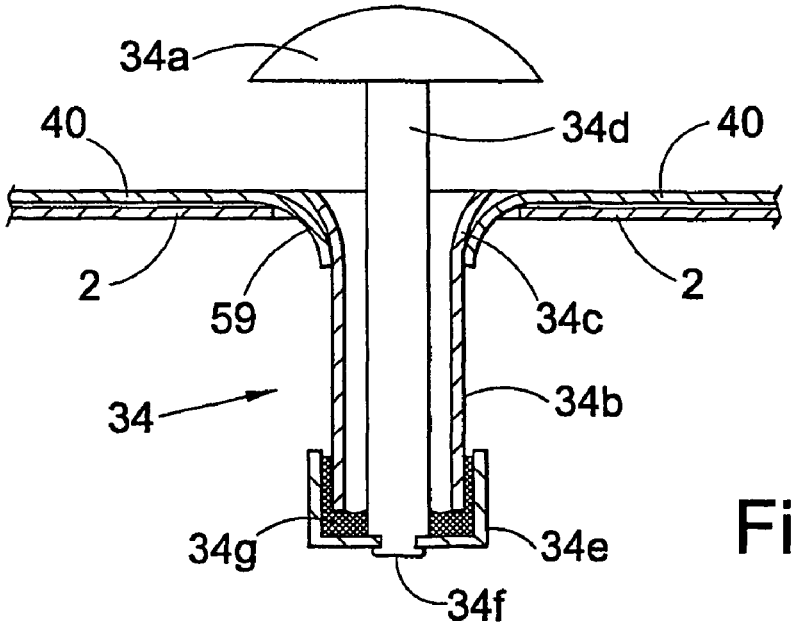
Figure 13:
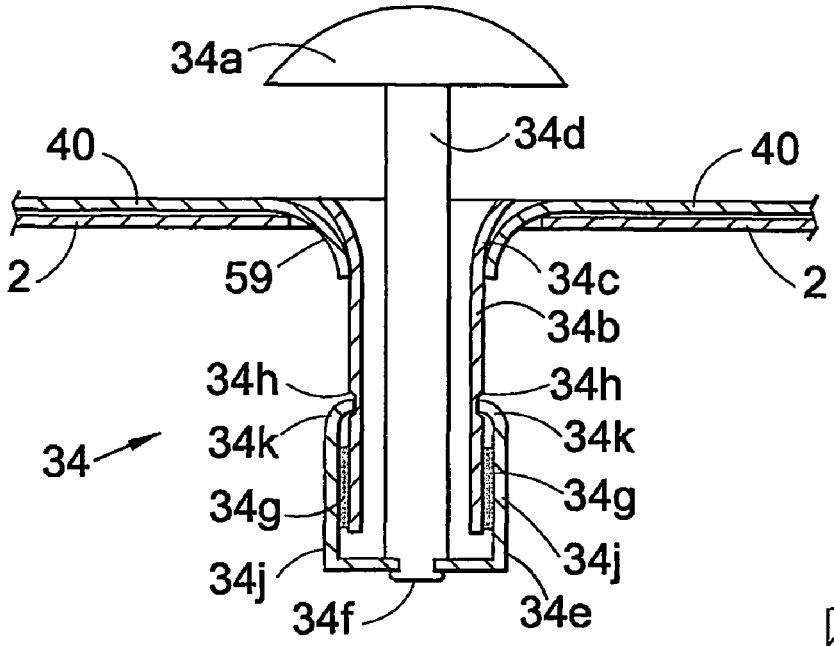
Figure 13A:
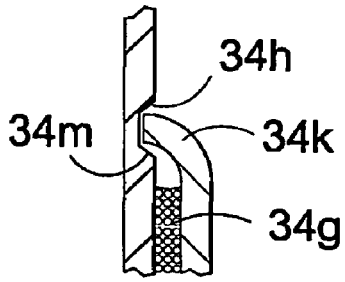
Figure 14:
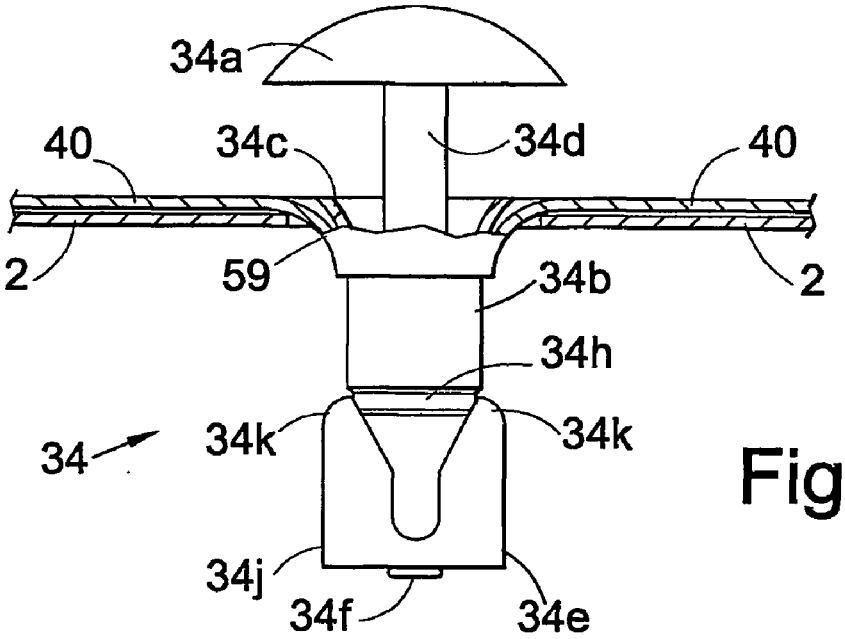

FIGS. 11*a* and 11*b* show the operation of a manual override lever in the mechanism of FIG. 6, and FIG. 11*b* also shows a visual indicator of the flap position;

FIG. 12 is a cross-sectional view of a temperature actuated release of the mechanism of FIG. 6;

FIG. 13 is a cross-sectional view of a modification of the temperature actuated release mechanism of FIG. 12, FIG. 13*a* showing a detail, and FIG. 14 is a side view of the mechanism of FIG. 13.

FIGS. 1 and 2 show duct wall 2 which is circular in cross-section. A continuous circular rim 4 having an inwardly extending flange 6 is riveted to the duct wall 2 at several positions around the rim by sealed rivets (not shown). The rim 4 has a step 8, to form a wall portion 10 which is spaced from the duct wall 2. The rim serves to provide a mounting and a stable mating surface for a flap or blade 12, and also strengthens the duct to maintain the duct shape in the region of the flap 12 to provide improved operation.

The flap or blade 12 is pivotably mounted on the rim 4 and is shown in full outline in its closed position, and in dotted outline in the open position.

As seen in FIG. 1, the blade is stepped or joggled at a diameter region 12*a* so that the halves of the flap 12*b*, 12*c* occupy planes to either side of and parallel to the plane of the flange 6, when the flap is in the closed position.

Referring to FIG. 2 the flap 12 is mounted on two stub axles 14 which rotate in sockets 16 formed on the rim 4. The stub axles 14 are a good fit in the sockets 16 to reduce any tendency of the flap to wobble, and also to provide a degree of sealing against the passage of smoke when the flap is closed. A single axle extending across the diameter of the flap may be used. The ends of the axle(s) may be sealed.

Heavy duty, i.e. strong, coil springs 18 surround the axles 14, and have one leg 20 bearing on the flange 6, and the other leg 22 bearing on the flap 12 to bias the flap into the closed position, against the flange 6.

The flap 12 is cut away at the edge 12*e* of the diameter region 12*a*, near the stub axles 14, to just clear the flange 6.

A cable 24 is attached at one end 26 to the flap region 12*b* and extends diagonally of the duct to exit through the duct wall 2, as will be described more fully hereinafter with reference to FIG. 6 et seq.

The flap 12 is overturned at its outer perimeter to form an axially extending flange 12*d* and a corner 12*f* to embrace the rim at the corner 11 formed at the radially outer edge of the flange 6 in portion 12*c*, and sit snugly at the corner 11 formed between the flange 6 and wall 10 at flap portion 12*b*. The flange 12*d* serves to strengthen the flap 12 to retain the shape of the flap during repeated operation and also provides an improved seal, as will be described hereinafter.

In operation, the cable 24 is pulled to rotate the flap 12 into the open position, shown in dotted outline, against the force of the springs 18. In the event of a fire, the cable 24 is released, allowing the flap to rotate to the closed position under the force of the springs 18. The overlap of the perimeters of the flap portions 12*b*, 12*c* adjacent flange 12*d* with the flange 6, and particularly the overlap at the corners 11, 12*f* ensures a good seal. The regions 12*e*, where the flap 12 is cut away may allow a small mount of air or smoke to pass but this will be rapidly blocked by soot etc., in the event of a fire.

By means of the cable 24, the flap 12 can be held in an intermediate position, thus serving to control the flow of air through the duct during normal operation. Typically, the degree of opening of the flap 12 would be set on installation of the system to balance air flow through the system, and then left.

In FIG. 3, the cross-section of the rim 4' is modified to replace the step 8 by an angled wall 10'.

In the duct 2 the normal air flow is in the flow direction of arrow A. Thus the fixings, such as the rivets holding rim 4 in place and the exit for cable 24, are closed or sealed. This reduces the risk of smoke escaping through the fixings once the flap 12 is closed. It will be appreciated the arrangement could be reversed, with air flowing in the direction of arrow B.

Figure 4:
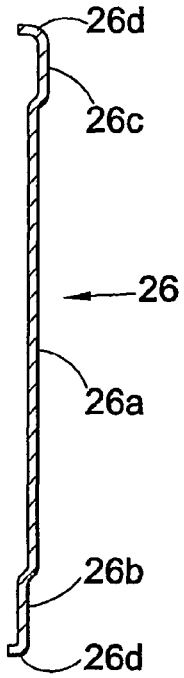
FIG. 4 shows in cross-section a second embodiment of a flap of the invention, which is particularly suitable for larger size ducts.
Figure 5:
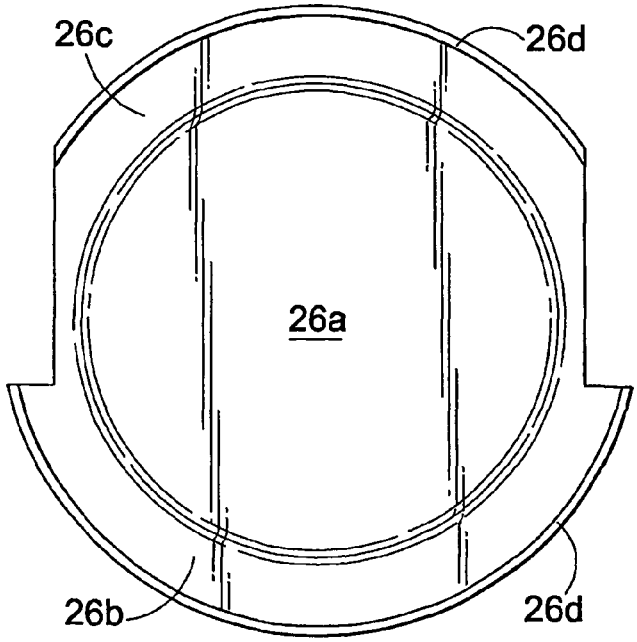
FIG. 5 is a plan view of the flap of FIG. 4.

FIGS. 4 and 5 shows a flap 26 which is a modified form of the flap 12. The centre portion 26*a* of the flap is flat. The outer perimeter of the flap is stepped to mate with the flange 6 of FIG. 1 At portion 26*c* the edge of the flap is dished, ending in a circumferential rim 26*d* forming a corner 26*e* and the flap 26 is stepped at portion 26*b*, with circumferential rim 26*d* forming a corner 26*e*.

The control of the flap 12, 26 by means of the cable 24 will now be described in more detail with reference to FIGS. 6 to 12.

FIG. 6 shows a flap 26 closing a duct 2 by bearing on a rim 4'. The stub axle mounting and spring biasing of the flap 26 are not shown but are as described with reference to FIGS. 1 to 5. The cable 24 exits the duct 2 at an angled tube 28 which extends through an aperture 30. A grommet (not shown) is provided on an end of the tube 28 to form a seal with the cable 24. Tube 28 is mounted on a control mechanism 32 which is riveted to the duct 2. Also shown in FIG. 6 is a fusible cartridge 34 which provides the temperature sensor of the temperature actuated control for releasing the cable 24 to allow the flap 26 to close.

Figure 7:
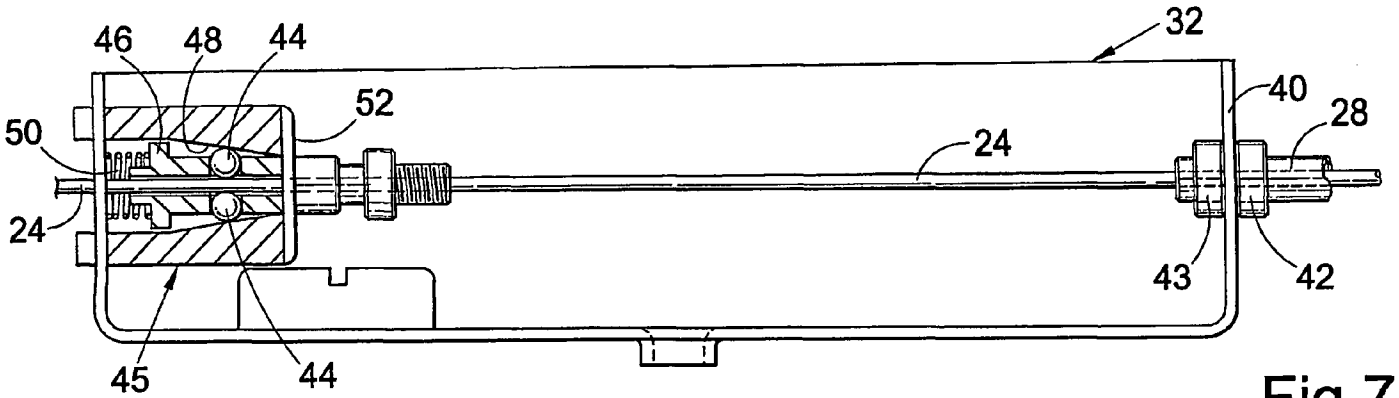
FIG. 7 is a detail of the control mechanism of FIG. 6 with some parts omitted.

Referring to FIG. 7, this shows a cross-section through the control mechanism 32. Mechanism 32 is contained in a housing 40 which is riveted to the duct 2 by sealed rivets (not shown). Cable 24 passes through tube 28 which is fixed to the housing 40 by nuts 42, 43. The cable 24 passes through the housing 40 and a ball clutch 45 mounted at the end of the housing 40 opposite inlet tube 28.

Ball clutches are well known and described for example in Ingenious Mechanisms by Franklin D. Jones, Vol. 2, Industrial Press Inc., Page 428. In brief, the cable 24 passes through a piston 46 and is gripped by two or more balls 44 which are held in the piston 46. Piston 46 is contained in a block 52 and is urged towards a conical surface 48 by a spring 50. Conical surface 48 forces the balls 44 inwards, to grip the cable 24. If the cable 24 is pulled to the left as seen in the drawing, which will open the flap 12, 26, this causes the piston 46 to move leftwards against the force of the spring, releasing the balls 44, so that the cable can then be pulled freely through the clutch.

Piston 46 extends outwards of block 52. Thus, the clutch can be released by urging piston 46 leftwards from outside the block 52. This forms the basis of a release mechanism for releasing cable 24, triggered by cartridge 34, to allow the flap 12, 26 to close.

Figure 9:
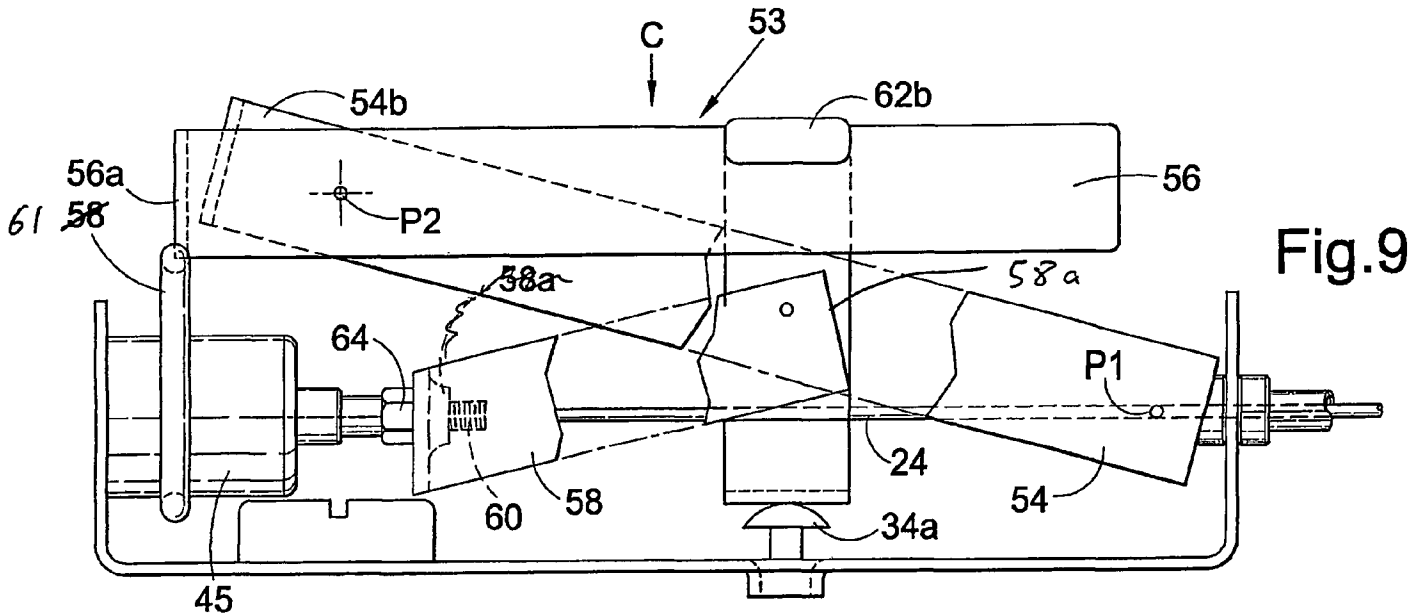
FIG. 9 is a side view of the control mechanism of FIG. 6, when it is set.
Figure 8:
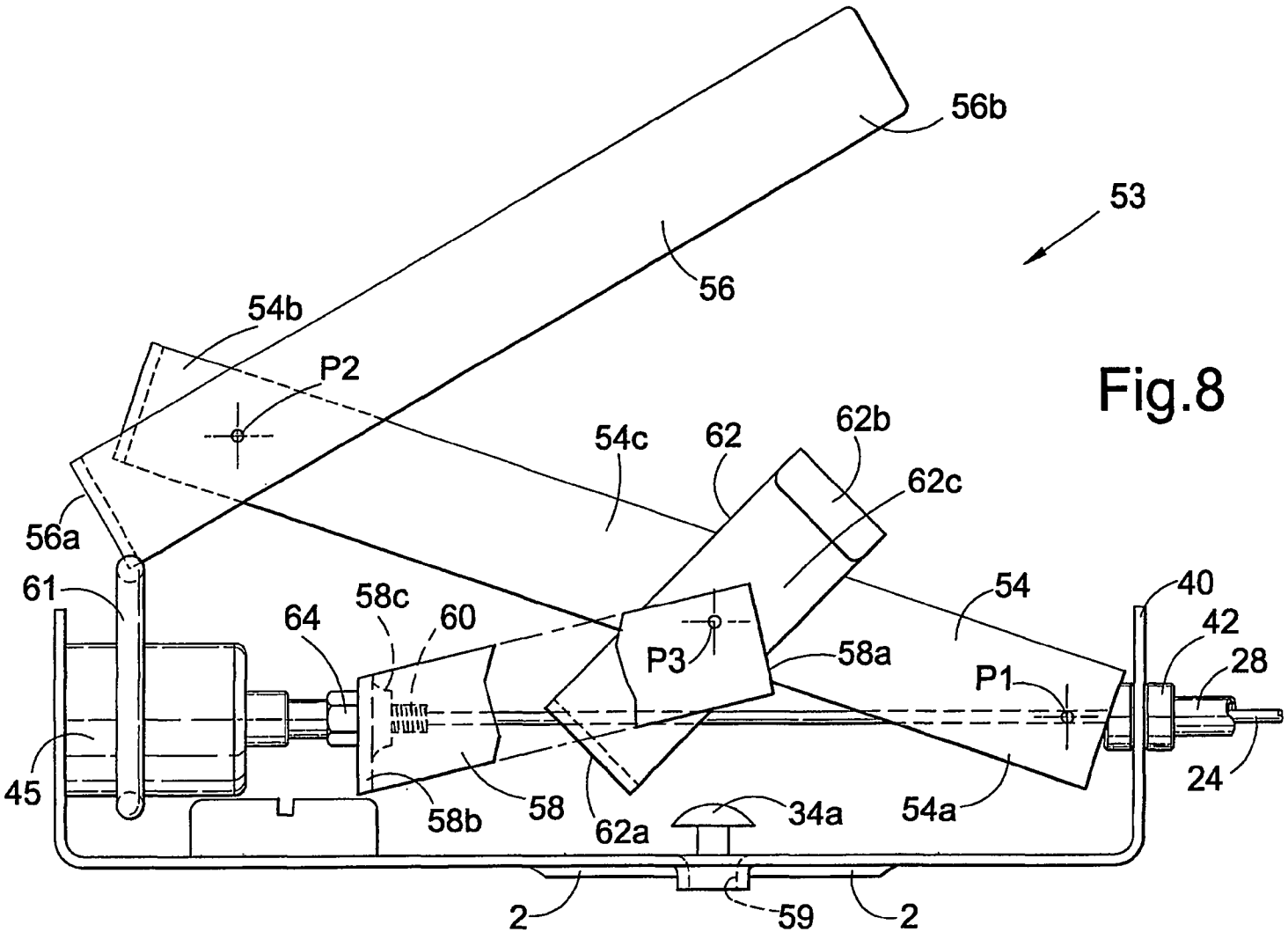
FIG. 8 is a side view of the control mechanism of FIG. 6, when it is being set.

FIGS. 8 and 9 are side view shows showing a release mechanism 53. FIG. 8 shows the mechanism 53 being set, and FIG. 9 shows the mechanism 53 after it has been set.

Referring to FIG. 8, a first lever 54 is pivotally mounted at a pivot point P1 at one end 54*a* in the housing 40. A second lever 56 is pivotably attached to the other end 54*b* of the first lever 54 at a pivot point P2, and attached to a coil spring 61. Coil spring 61 passes around the block 52 of ball clutch 45 and is attached at each end to the lever end 56*a*.

A release member 58 is pivotally attached at one end 58*a* to a central region 54*c* of lever 54 at a pivot point P3. Release member 58 is U-shaped and a web 58*b* has an aperture 58*c* which passed over a stub axle 60 formed on the end of the piston 46 where it projects from the block 52.

It can be seen that as the free end 56*b* of lever 56 is urged downwards, it will urge lever end 54*b* downwards, in turn moving lever portion 54*c* down and to the left as it pivots about pivot P1, thus urging the release member 58 leftwards. Release member 58 pivots at pivot P3.

A U-shaped break member 62 is also pivotably mounted on lever 54 at pivot point P3. Member 62 has a web 62*a* which, when the mechanism is "loaded", bears on the head 34*a* of cartridge 34. Break member 62 limits the downward movement of lever 54 (FIG. 9), and so limits the leftward travel of the release member web 58*b*.

Referring to FIG. 9, the lever 56 has been pushed fully downwards, and is clipped under a finger 62*b* formed at the end of arm 62*c* of brake member 62.

It can be seen that lever end 54*a* is fixed by pivot point P1, and lever 54 is held against further downward movement by brake member 62 bearing on head 34*a* of cartridge 34. The mechanism is tensioned by spring 61 which pulls lever end 56*a* downwards. In this "set" position, web 58*b* of the release member 58 rests just short of an adjustable nut 64 on stub axle 60.

As will be described with reference to FIG. 12, when release cartridge 34 is heated, as by flames in duct 2, head 34*a* drops, allowing brake member 62 and lever 54 to pivot further downwards, urging release member web 58*b* leftwards to bear on nut 64, and hence urge the piston 46 leftwards to release the ball clutch 45. Cable 24 is thus released, and flap 12, 26 is forced closed by the springs 18. Head 34*a* of cartridge 34 will seal the aperture 59 formed in housing 40 and the duct wall 2.

Figure 10:
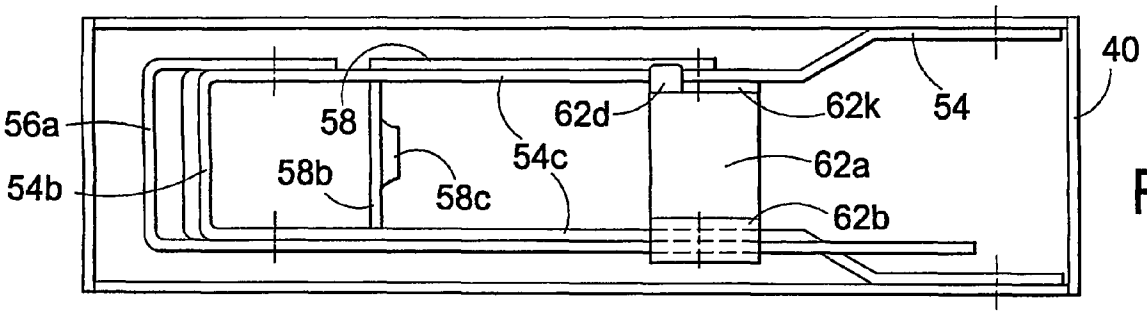
FIG. 10 is a view on Arrow C of FIG. 9.

Referring to FIG. 10, a lug 62*d* on the other arm 62*k* of break member 62 prevents the member pivoting past the head 34*a* when the mechanism is being set.

To test that the flap 12, 26 closes, a manual release mechanism is provided, as shown in FIGS. 11*a* and 11*b*. A manually operated lever 70 pivots at one end 70*a* in a notch 72 and has a slot. (not shown) which embraces the stub axle 60. As the lever is pivoted to the left about notch 72, as shown in FIG. 11*b*, the piston member 46 is urged leftwards to release the ball clutch 45. Lever 70 slides in a slot 40*b* in the housing cover 40*c*.

Also shown in FIG. 11*b* is an indicator for allowing visual inspection of the flap portion. The indicator is an elongate pin 80 which is screwed at one end 80*a* into a nipple 82 fixed in position on the cable 24, and extending through slot 40*b*. As shown in FIG. 11*b*, the cable has been released and the flap 12, 26 is in the closed position. As the cable is pulled leftwards, opening the flap, the pin 80 is slid along the slot 40*b*.

To allow for release of the flap 12, 26 by other devices, e.g. smoke alarms or fire alarms external of the duct, an electromechanical actuator may be mounted on lever 70 at the outer end 70*b*.

The release cartridge 34 is carried by the base of the housing 40 and projects into the duct 2. FIG. 12 shows a cut-away detail view of release cartridge 34. A pin casing 34*b* is of brass and swaged over at its outer end 34*c* and a push fit in the extruded aperture 59 in the housing 40. Steel pin 34*d* has a brass cup 34*e* mounted on its lower end by a rivet 34*f*. Cup 34*e* is attached to casing 34*b* by solder 34*g*, holding the pin 34*d* raised in the casing 34*b*. When heated, as by flames, solder 34*g* melts, so that the break member 62, which urged against the pin head 34*a* by spring 61, will force the pin 34*d* downwards through the casing 34*b*, at the same time triggering the release of the cable via release member 58. Cup 34*e* remains on the end of the pin 34*d*, and so there is no risk of it fouling the flap 12, 26.

The release cartridge is intended to trigger or fuse close to a pre-determined temperature governed by the melting point of the solder 34*g*, say at about 70° C. However, the solder may soften appreciably below this temperature.

From FIG. 12 it can be seen that the solder 34*g* is in shear between the casing 34*b* and the wall of cup 34*e*. Hence it is possible for the cartridge to trigger below the designated temperature because the sustained pressure on pin 34*d* from the release mechanism, via break member 62, will slowly cause the solder to shear, allowing pin 34*d* to drop into the cylinder 34*b*.

To overcome this, the embodiment of FIGS. 13 and 14 uses a mechanical or form-locking connection between the cup 34*e* and the casing 34*b* which resists the shearing force between cup 34*e* and casing 34*b*.

A circumferential slot 34*h* is provided in the outer surface of the casing 34*b*. Cup 34*e* has two diametrically opposed legs 34*j* which extend upwards and end in inturned nibs or lips 34*k* which engage in slot 34*h*. Solder 34*g* holds the legs 34*j* against the outer surface of casing 34*b*. Slot 34*h* has a sloping lower wall 34*m* on which the lip 34*k* bears.

The pressure on pin head 34*a*, from break member 62, will tend to force the lips 34*k* out of engagement with slot 34*h*. This requires outward flexing of the legs 34*j* which is resisted by the solder 34*e* bonding the legs 34*j* to the cylinder 34*b*. Solder 34*e* is not under substantial shear, and the force tending to separate the legs 34*j* is lower than the shearing force of the FIG. 12 embodiment because the force is acting in a different direction. Thus solder 34*g* will not creep or give significantly until it is at or near its designed melting point, of about 70° C. in this example.

When the solder 34*g* reaches its melting point, the legs 34*j* are released, and the force on head 34*a* of pin 34*d* is sufficient to drive the cup 34*e* down, disengaging the lips 34*k* from sloping wall 34*m* of slot 34*h*. In turn, the trigger mechanism releases the flap 26, as described above.

The flap 26, rim 4 and release mechanism 32 may be provided as an assembly or kit to be fitted in a length of duct. Preferably a length of duct is pre-fitted with the assembly, ready for installation in a building etc. To further strengthen the duct against deformation, a rim or band 90 may be fixed upstream of the flap 26.

Although the invention has been particularly described with reference to a circular cross-section duct it may also be used with a square or rectangular cross-section duct.

Various modifications will be apparent to those in the art. Although the invention has been described with particular reference to circular cross-section ducts, it can be used with rectangular or other cross-section ducts.

What is claimed is:

1. A fire damper in a ventilation duct, the damper comprising a flap which is mounted on an axle in the duct to pivot for movement from an open position, allowing air flow along the duct, to a closed position under the action of a biasing force to inhibit air flow or the passage of flame along the duct, wherein a rim is provided on the duct wall, the rim having a rim wall which extends parallel to the duct wall and a flange which extends radially from an end of the rim wall into the duct space to provide a corner where the flange extends inwardly from the rim wall, and the flap has a corner formed at its peripheral edge to mate with the corner of the rim when the flap is in the closed position, wherein the rim wall extends substantially continuously around the inner surface of the duct wall and the flange is planar, and wherein the flap is stepped, whereby the flap peripheral edge on one side of the flap axle mates with one side of the flange, and the flap peripheral edge on the other side of the flap axle mates with the other side of the flange.

2. A fire damper as claimed in claim 1, wherein the flap is mounted to pivot about a central axis.

3. A fire damper as claimed in claim 2, wherein a radially extending flange is provided on the rim.

4. A fire damper as claimed in claim 3, wherein the flap is stepped in the region of its centre axis, the flap portion either side of the step laying flat against respective sides of the flange when the flap is in the closed position.

5. A fire damper as claimed in claim 1, wherein the flap is mounted on an axle which turns in a socket on the inside of the duct wall.

6. A fire damper as claimed in claim 3, wherein a corner is formed where the flange extends inwardly of the rim, and the flap has a corner formed at it peripheral edge to mate with the corner on the rim.

7. A fire damper as claimed in claim 1, wherein the rim extends substantially continuously around the inner surface of the duct wall.

8. A fire damper as claimed in claim 1, wherein the duct has a circular cross section.

9. A fire damper as claimed in claim 8, wherein the flap is held in the open position by a cable which extends from the flap to outside of the duct.

10. A fire damper as claimed in claim 9, wherein the cable is held outside the duct by a release mechanism, which releases the cable if a fire is detected in the duct.

11. A fire damper as claimed in claim 10, wherein means is provided for holding the cable at different positions to hold the flap at positions intermediate the open position and the closed position.

* * * * *